US007980660B2

(12) United States Patent
Kojima

(10) Patent No.: US 7,980,660 B2
(45) Date of Patent: Jul. 19, 2011

(54) INK JET PRINTER AND METHOD OF CLEANING PLATEN

(75) Inventor: Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 24 days.

(21) Appl. No.: 12/413,128

(22) Filed: Mar. 27, 2009

(65) Prior Publication Data

US 2009/0244175 A1 Oct. 1, 2009

(30) Foreign Application Priority Data

Mar. 28, 2008 (JP) ..... 2008-086802

(51) Int. Cl.
*B41J 2/165* (2006.01)

(52) U.S. Cl. ..... 347/33
(58) Field of Classification Search ..... None
See application file for complete search history.

(56) References Cited

FOREIGN PATENT DOCUMENTS

JP 2004-25666 A 1/2004

OTHER PUBLICATIONS

Tetsuya et al. (JP 2004-025666)—Note that this is a machine translation.*

* cited by examiner

*Primary Examiner* — Matthew Luu
*Assistant Examiner* — Alejandro Valencia
(74) *Attorney, Agent, or Firm* — Birch, Stewart, Kolasch & Birch, LLP

(57) ABSTRACT

An ink jet printer feeds a sheet of recording medium onto a platen, and record an image by ejecting droplets of ink from a print head attached to the platen. The ink jet printer has a media deforming section for deforming a part of the recording medium into a downward projection. The media deforming section includes a wedge above a recording media feeding path, and a wedge receiver below the feeding path to fit with the wedge. The wedge and the wedge receiver are joined together to press the recording medium from above and below, and form the downward projection. While the recording medium passes the platen, the downward projection wipes off ink stain on ribs of the platen.

11 Claims, 12 Drawing Sheets

INK JET PRINTER AND METHOD OF CLEANING PLATEN

FIELD OF THE INVENTION

The present invention relates to an ink jet printer and a method of cleaning a platen.

BACKGROUND OF THE INVENTION

Ink jet printers are a very common type of household printer. The ink jet printer ejects droplets of ink from a set of nozzles onto a recording medium, such as a paper, by oscillating a piezo element or by boiling the ink. For fineness of printing, the current ink jet printers are designed to eject extremely minute droplets of ink, as small as a few to a few dozen picoliters.

As the ink droplets become smaller, they tend to fly unstably when ejected. In addition, fine mists of ink are also ejected. These mists are extremely small droplets, but when accumulated, they will cause a problem. Especially, when the mists accumulate on a platen which supports a sheet of recording medium horizontally flat, they contaminate the next recording medium, and lower print quality.

Some of the ink jet printers provide duplex printing capability. In the duplex printing process, a recording medium is reversed when an image has been printed on the front surface thereof, and then an image is printed on the rear surface. During this process, the front surface of the recording medium with the image printed is fed (conveyed) to slide on the platen, and leaves the ink to contaminate the platen. The contamination of the platen could be prevented if the recording medium is fed to the platen after the ink on the front surface had penetrated and fixed (dried) completely. In the recent years with growing demand for high speed printing, however, it is a common practice to start printing on the rear surface before the ink on the front surface has completely fixed.

Under this circumstance, a cleaning sheet is conventionally used to remove ink stain on the platen. Made of a special material, this type of cleaning sheet is expensive. Therefore, there is disclosed a method of removing ink stain on the platen with use of an inexpensive recording medium, such as a regular paper (see, for example, Japanese Patent Laid-open Publication No. 2004-25666). According to this method, a recording medium is moved back and forth with the front end thereof touching the upper surface of the platen, so as to wipe off the dirt, or ink stain, on the platen during feeding.

However, this method may be of little effect when the front end of the recording medium is deformed for some reasons, and fails to touch the platen. This problem may be solved by bending a part of the recording medium into a downward projection, and wiping the platen with this downward projection. This approach, however, requires a user to bend the recording medium. In addition, this approach may lead to misbending or overbending which cause jamming or other errors in feeding the recording medium.

SUMMARY OF THE INVENTION

In view of the foregoing, it is an object of the present invention to provide an ink jet printer and a platen cleaning method to remove ink stain on a platen easily without fail.

In order to achieve the above and other objects, an ink jet printer according to the present invention includes a feeding mechanism for feeding a sheet-like recording medium, a recording head for ejecting droplets of ink, a platen disposed below the recording head, and a first media deforming mechanism for deforming a part of the recording medium into a downward projection. While the recording medium is fed to pass the platen, the downward projection wipes off ink stain on the platen.

It is preferred for the feeding mechanism to move the downward projection back and forth on the platen. This movement of the downward projection surely removes dirt on the platen.

It is also preferred to place the first media deforming mechanism upstream from the platen in a feeding direction of the recording medium. This configuration allows the recording medium to wipe off the ink stain from the first time it passes over the platen. The downward projection is bent into a V-shape.

In a preferred embodiment of the present invention, the first media deforming mechanism includes a wedge disposed above a feeding path of the recording medium, and a wedge receiver disposed below the feeding path. The wedge and the wedge receiver are joined together to press the recording medium from above and below into the downward projection. This requires only a simple and inexpensive configuration to form the downward projection.

In addition, guide members to support the recording medium are provided on both sides of the wedge and the wedge receiver. The first media deforming mechanism changes a position to join the wedge and the wedge receiver in an above-below direction, and changes a degree of projection of the downward projection as desired.

In another preferred embodiment of the present invention, there is provided a second media deforming mechanism for deforming a part of the recording medium into an upward projection. While the recording medium passes over the platen, the upward projection wipes off ink stain on the recording head of the platen.

It is preferred to provide first ribs and second ribs on the platen, and arrange them in rows in a main scanning direction orthogonal to a feeding direction of the recording medium. The first ribs are displaced from the second ribs in both the feeding direction and the main scanning direction. This arrangement of the ribs reduces a feeding load of the recording medium, and facilitates removing the dirt on the ribs.

In this case, the feeding mechanism feeds the recording medium to move the downward projection back and forth on each of the first and second ribs. This movement ensures proper dirt removal.

A method of cleaning a platen according to the present invention includes a step of feeding a sheet-like recording medium to a projection forming station, a step of forming a part of the recording medium into a downward projection in the projection forming station, and a step of feeding the recording medium to wipe off the ink on the platen with the downward projection.

It is preferred that the ink wiping step includes moving the downward projection back and forth plural times on the platen.

According to the present invention, the media deforming mechanism forms the downward projection in a part of the recording medium during cleaning of the platen. With this downward projection, the ink stain on the platen are removed surely and easily.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS

Figure 1:
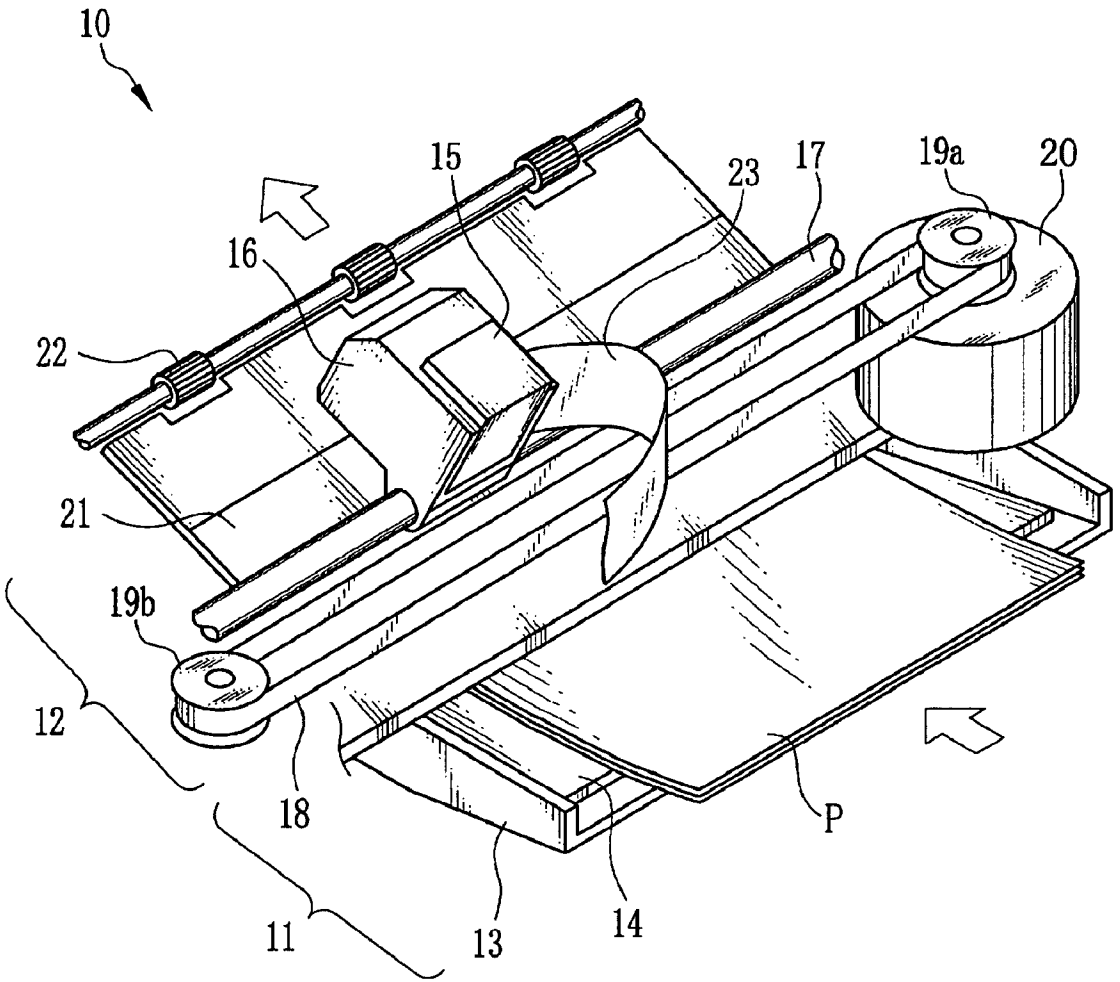
FIG. 1 is a schematic perspective view of an ink jet printer according to the present invention.

Referring to FIG. 1, an ink jet printer 10 includes a paper supply section 11 for feeding a sheet-like recording medium P, such as a recording paper, and a recording section 12 for recording (printing) an image onto the recording medium P. The paper supply section 11 has a base plate 13 that rotatably supports a pressure plate 14, on which a plurality of the recording media P is placed. Provided also with a later described supply roller 31 and a separation pad 32 (see, FIG. 2), the paper supply section 11 separates one sheet of the recording medium P from the stack on the pressure plate 14, and feed it to the recording section 12.

The recording section 12 includes a carriage 16 that detachably mounts a cartridge type recording head 15. The recording head 15 has an array of ink nozzles that eject droplets of ink onto the recording medium P. The carriage 16 is slidably supported on a guide shaft 17 extending in a main scanning direction, and connected to a part of a drive belt 18 which moves the carriage 16. The drive belt 18 is looped around a pair of pulleys 19*a*, 19*b* spaced apart from each other in the main scanning direction. The pulley 19*a* is attached to a rotary shaft of a carriage motor 20, which moves the carriage 16 back and force in the main scanning direction through the drive belt 18.

In the recording section 12, the recording medium P passes through a feed roller 33 (see, FIG. 2) and rests on a platen 21. Having passed through the platen 21, the recording medium P is nipped between a discharge roller 22 and a sprocket wheel 42 (see, FIG. 2), and fed in a direction of an arrow (sub scanning direction) by a drive force of a feed motor 58 (see, FIG. 4). During the feeding of the recording medium P, the carriage 16 moves and the recording head 15 ejects ink droplets to form an image on the recording medium P with ink dots. The carriage 16 is connected to a flexible board 23 that transmits drive data from a head driver 59 (see, FIG. 4) to the recording head 15, and the ink nozzles in the recording head 15 perform an ink ejecting operation according to the drive data from the head driver 59.

Figure 2:
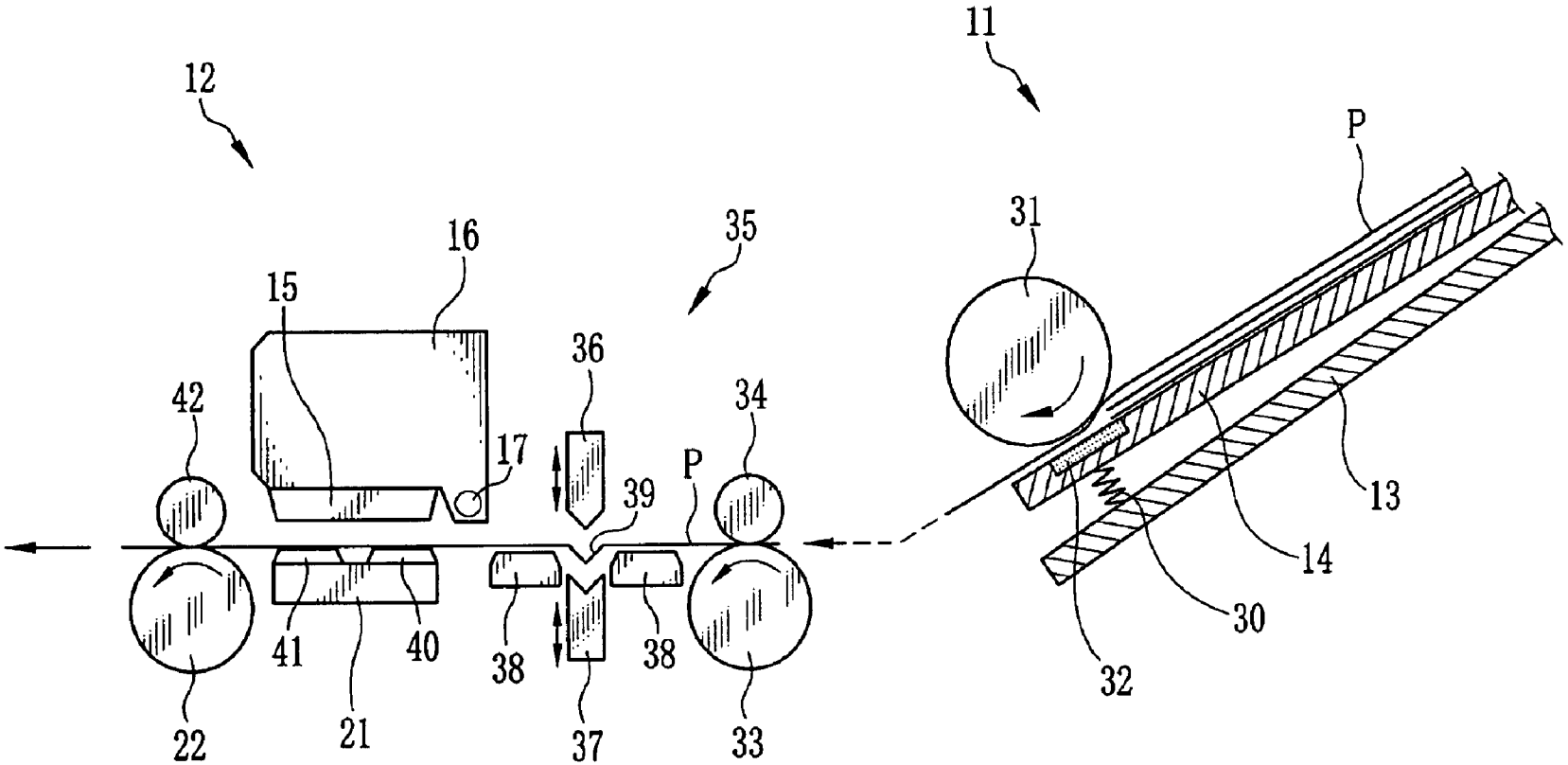
FIG. 2 is a schematic side elevation view of the ink jet printer.

As shown in FIG. 2, the pressure plate 14 is biased to the supply roller 31 with a spring 30 attached to the base plate 13. The pressure plate 14 is also provided with the separation pad 32 that faces the supply roller 31. The separation pad 32 is made of urethane or the like, and holds the lower one of two overlapping recording media P with a frictional force, preventing misfeed.

The supply roller 31 is made of an elastic material, such as rubber. In the paper feed operation, the supply roller 31 is rotated by the feed motor 48 to produce a frictional force, which feeds the recording media P sheet by sheet from the top of the stack on the pressure plate 14 to the recording section 12.

The feed roller 33 works together with a pinch roller 34 which is pressed against the feed roller 33, and feeds the recording medium P to the platen 21. On a downstream side in the feeding direction from the feed roller 33 and the pinch roller 34, there is a projection forming station which includes a media deforming section 35 to deform a part of the recording medium P during a cleaning operation of the platen 21. The media deforming section 35 includes a wedge 36 disposed above a feeding path of the recording medium P, a wedge receiver 37 disposed below the feeding path to face the wedge 36, and a pair of guide blocks 38 disposed upstream and downstream of the wedge receiver 37 in the feeding direction.

The wedge 36 has a V-shaped lower face that projects downwardly to the feeding path, and the tip of this lower face extends in the main scanning direction (orthogonal to the paper surface of the drawing). The wedge receiver 37 has a V-shaped upper face that recesses to fit with the lower face of the wedge 36. Each of the wedge 36 and the wedge receiver 37 has a shift mechanism (not shown), and is moved in a vertical direction (approaching/retracting direction to the feeding path) by the first and second drive motors 62, 63 (see, FIG. 4) respectively. As the recording medium P is held between the guide blocks 38, the wedge 36 and the wedge receiver 37 are shifted to join across the recording medium P, and a downward projection 39 is formed on the recording medium P. Extending in the main scanning direction, this downward projection 39 is used for cleaning first and second ribs 40, 41 on the platen 21.

Figure 3:
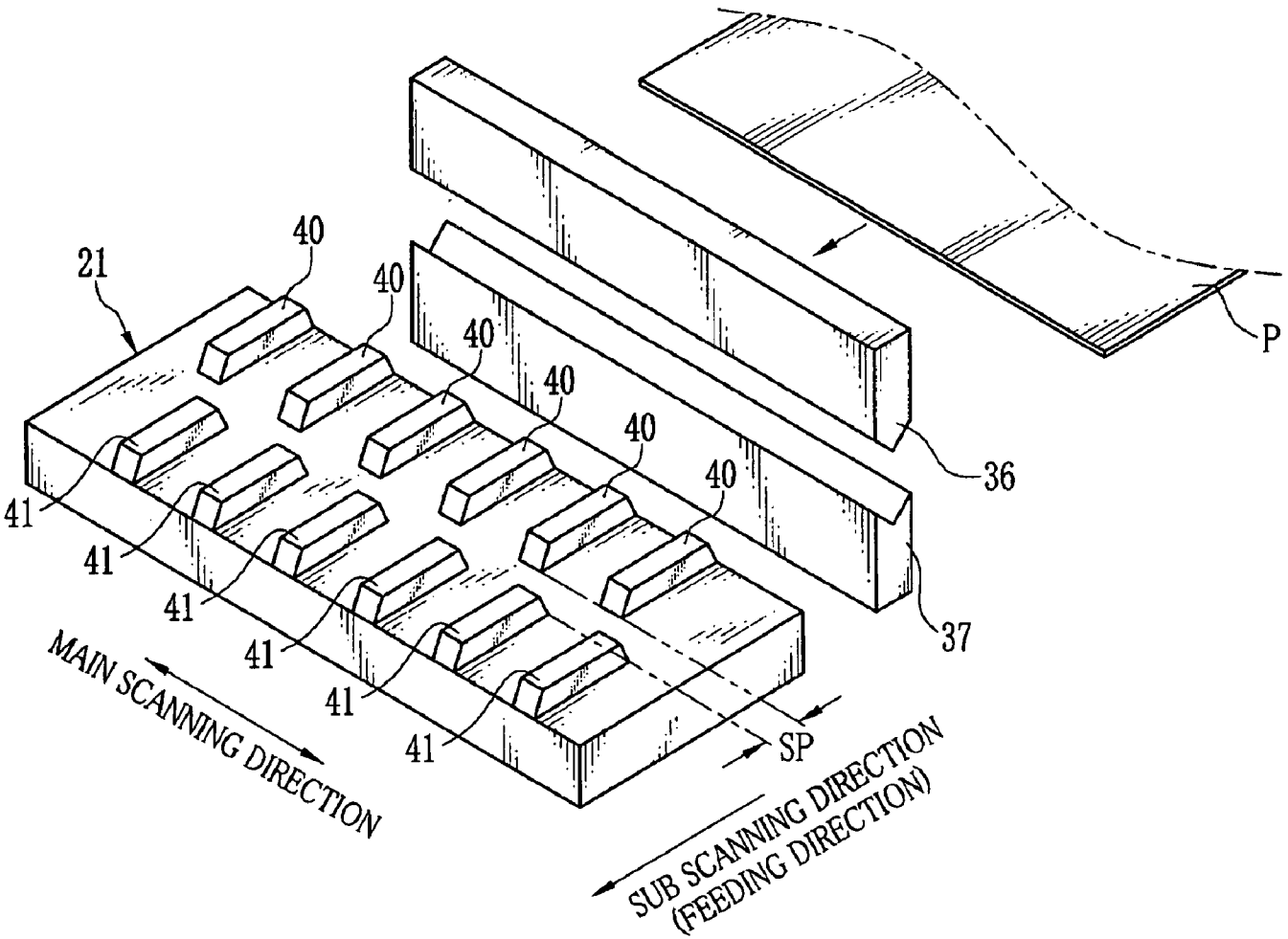
FIG. 3 is a schematic perspective view of a media deforming section.

As shown in FIG. 3, a plurality of the first and second ribs 40, 41 is provided on the platen 21. These first and second ribs 40, 41 extend in the feeding direction of the recording medium P (or the sub scanning direction), and are arranged at regular intervals in two lines along the main scanning direction. The first ribs 40 form a first line on the upstream side in the feeding direction, while the second ribs 41 form a second line on the downstream side in the feeding direction. With respect to the main scanning direction, each of the second ribs 41 lies between two first ribs 40. In this embodiment, each second rib 41 is shifted by half a pitch from the first rib 40 (i.e., located in the middle of adjacent first ribs 40) in the main scanning direction.

The first ribs 40 are separated from the second ribs 41 by a gap SP in the sub scanning direction. This gap SP is created for borderless printing to leave no blank space on the edges of the recording medium P. On this gap SP, the edges of the recording medium P are printed. The ink droplets that fail to fix on the recording medium P will drop into the gap P, and thus the first and second ribs 40, 41 are hardly contaminated.

Referring back to FIG. 2, the discharge roller 22 and the sprocket wheel 42 are placed downstream in the feeding direction from the platen 21, and the sprocket wheel 42 is pressed against the discharge roller 22. The discharge roller 22 works together with the sprocket wheel 42, and discharges the recording medium P having an image formed by the recording head 15 to a paper discharge tray (not shown).

Figure 4:
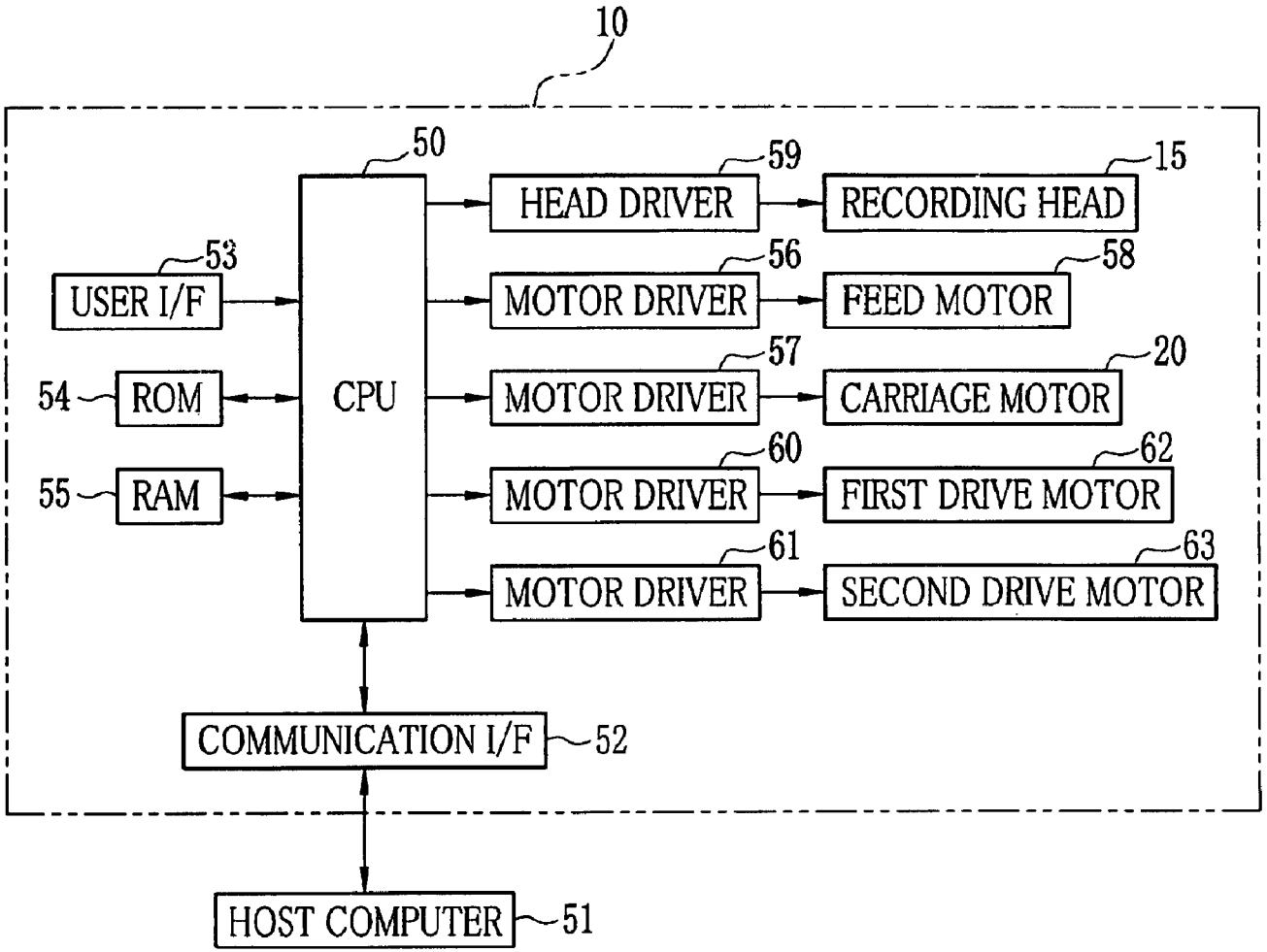
FIG. 4 is an electrical block diagram of the ink jet printer.

As shown in FIG. 4, a CPU 50 controls every component in the ink jet printer 10, based on the drive data entered from a communication interface (I/F) 52 that establishes communication between the CPU 50 and a host computer 51, and setup data entered from a user interface (I/F) 53.

A ROM 54 is a nonvolatile memory, such as a flash memory which allows data overwrite. The ROM 54 stores control programs and various setup data (including the setup data from the user I/F 53) for operation of the ink jet printer 10. The CPU 50 runs these programs to control the components.

A RAM 55 is a volatile memory, such as an SDRAM, for high speed data reading and writing. Print data entered from the host computer 51 is written to the RAM 55. This print data in the RAM 55 is retrieved by the CPU 50, and converted from raster data into drive data for driving the recording head 15, and then written back to the RAM 55.

The CPU 50 controls motor drivers 56, 57 to drive the feed motor 58 and the carriage motor 20. In addition, the CPU 50 sends the drive data in the RAM 55 to the head driver 59, and operates the recording head 15 to print an image on the recording medium P.

During the cleaning operation, the CPU 50 controls motor drivers 60, 61 to activate the first and second drive motors 62, 63. The first drive motor 62 moves the wedge 36 up and down, and the second motor driver 63 moves the wedge receiver 37 up and down to oppose the wedge 36, so as to form the downward projection 39 on the recording medium P.

A degree of projection (deformation) of the downward projection 39 is adjusted to a setup value entered through the user I/F 53. According to the setup value, the CPU 50 changes a position to join (joining position) the wedge 36 and the wedge receiver 37 in the up/down direction, and controls a projection degree of the downward projection 39.

Figure 5A:
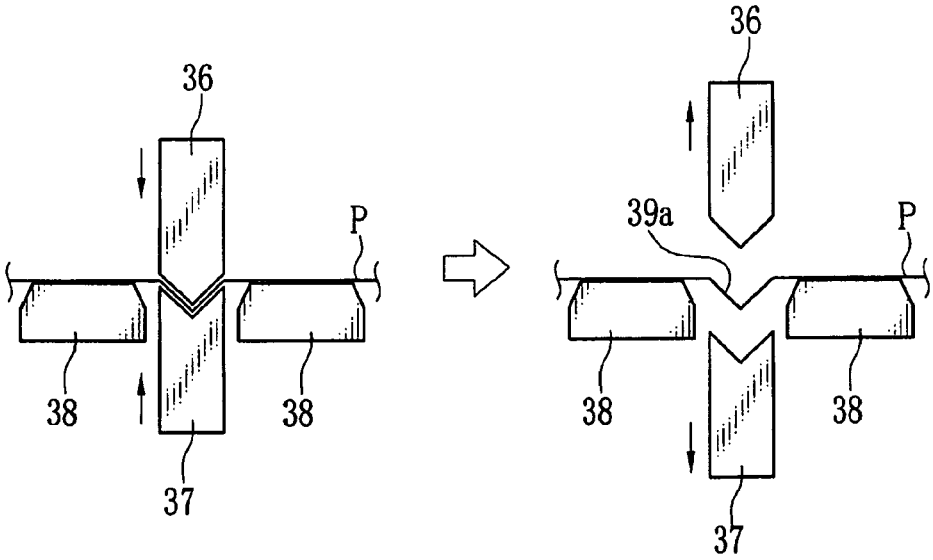
FIG. 5A is an explanatory view of a process to form a downward projection with a low projection degree.
Figure 5B:
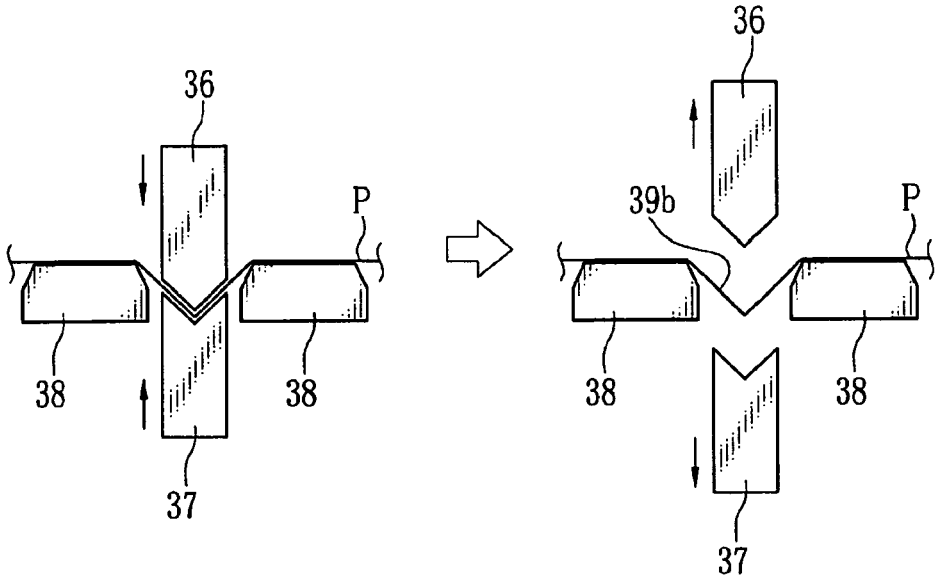
FIG. 5B is an explanatory view of a process to form a downward projection with a high projection degree.

Specifically, when a small setup value is entered, the CPU 50 locates the fitting position level with the top surface of the guide blocks 38, as shown in FIG. 5A. In this case, the recording medium P is deformed into a downward projection 39*a* having a V-shape almost identical to the lower face of the wedge 36. In contrast, when a large setup value is entered, the CPU 50 locates the fitting position below the top surface of the guide blocks 38, as shown in FIG. 5B. In this case, the recording medium P is deformed not only by the wedge 36 and wedge receiver 37, but also by the guide blocks 38, ending up having a downward projection 39*b* with a larger degree of projection (projection degree) than the downward projection 39*a*.

Figure 6:
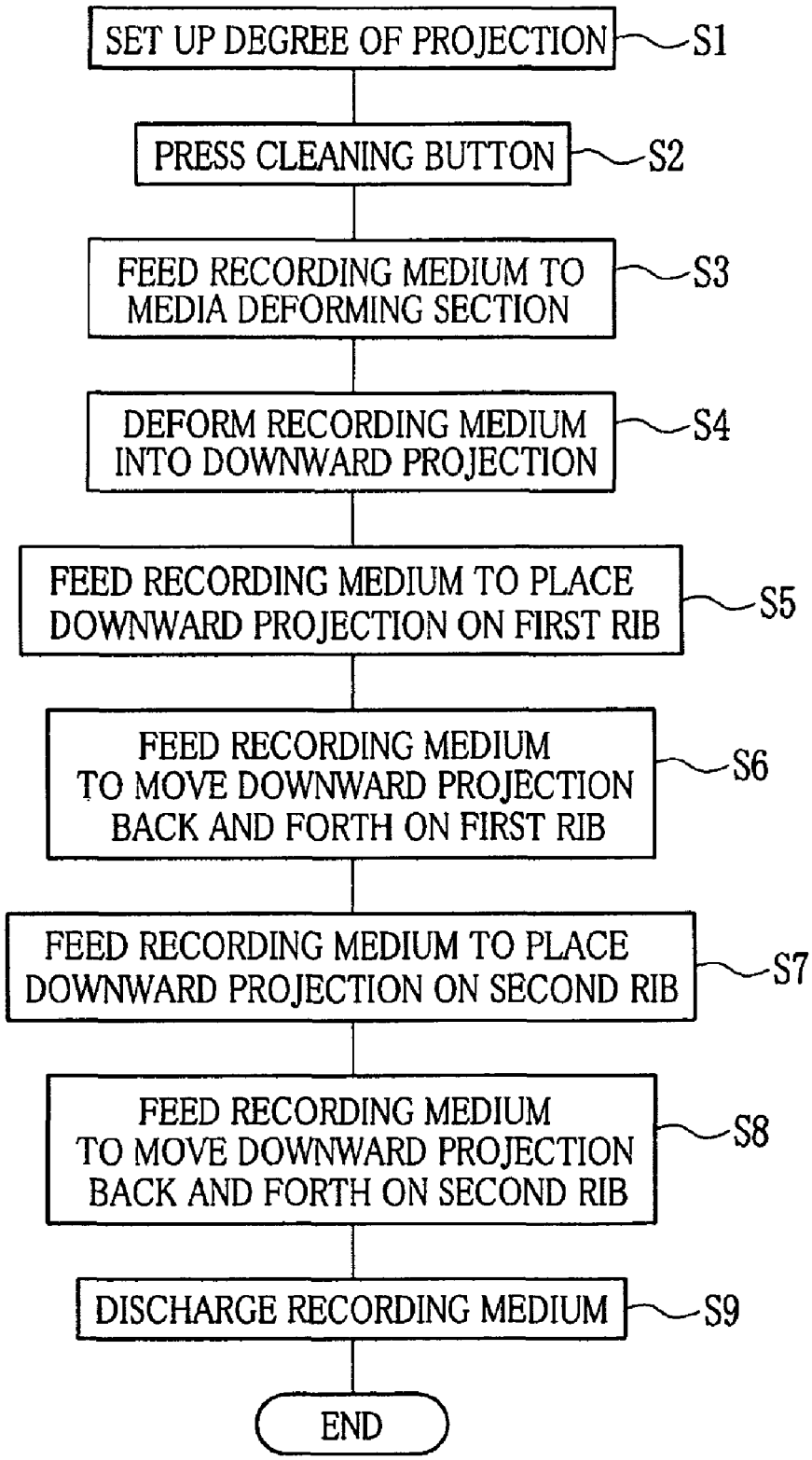
FIG. 6 is a flow chart of a rib cleaning operation.

Hereafter explained, with reference to a flowchart of FIG. 6, is the cleaning operation to the first and second ribs 40, 41 on the platen 21. This cleaning operation is carried out using a regular paper or such a common printing medium as the recording medium P. In response to a press on a cleaning button in the user I/F 53, the CPU 50 starts the cleaning operation. Before pressing the cleaning button, a projection degree of the downward projection 39 to be formed in the recording medium P can be entered.

Figure 7A:
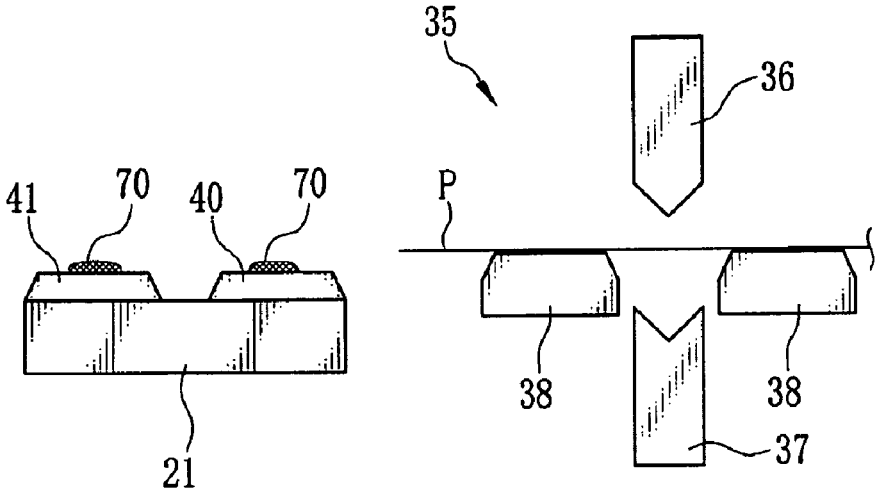
FIG. 7A to FIG. 7D are schematic side elevation views illustrating the rib cleaning operation.
Figure 7B:
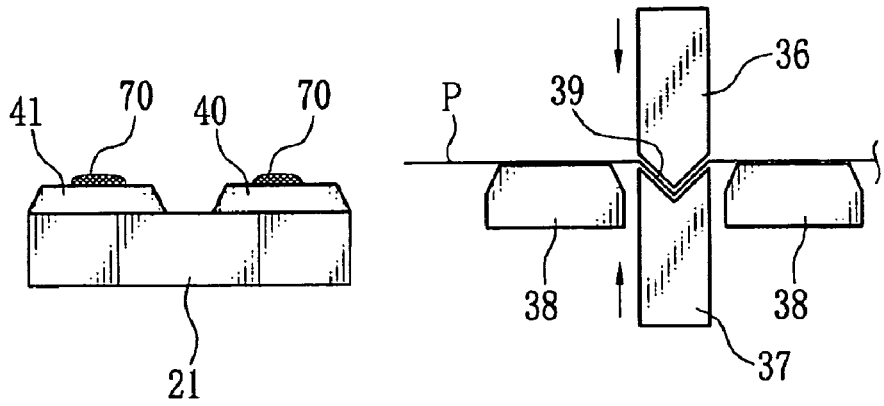

When a projection degree is set up (step S1) and the cleaning button is pressed (step S2), the CPU 50 operates the motor driver 56 to feed the uppermost recording medium P on the pressure plate 14 to the projection forming station, as shown in FIG. 7A (step S3). The CPU 50 operates the motor drivers 60, 61 to move the wedge 36 and the wedge receiver 37 to join them together at a fitting position corresponding to the set projection degree, so that the recording medium P is pressed to deform into the downward projection 39 having the set projection degree (step S4).

Figure 7C:
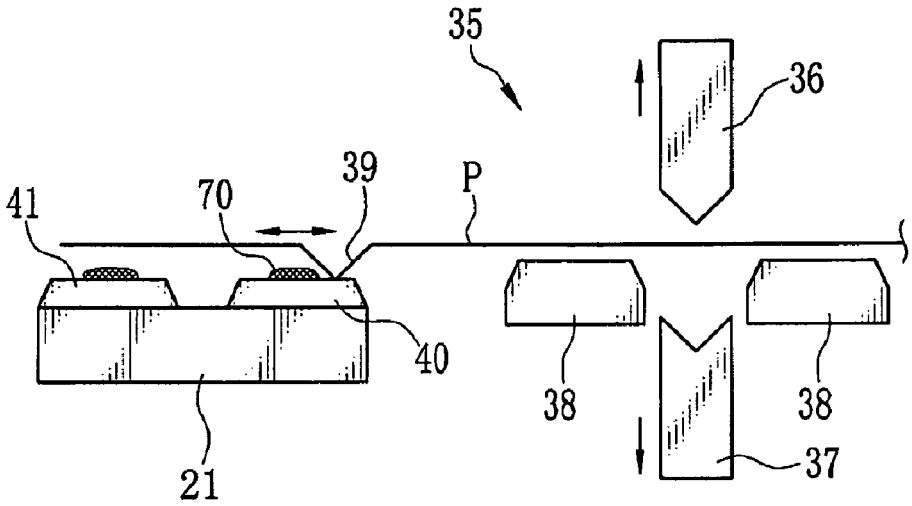

Then, the CPU 50 operates the motor driver 56 to feed the recording medium P to place the downward projection 39 on the first rib 40 of the platen 21, as shown in FIG. 7C (step S5). The CPU 50 feeds this recording medium P, so that the downward projection 39 moves back and forth on the first rib 40 (step S6). During this movement, the pointed end of the downward projection 39 slides on the first rib 40, wiping off ink stain 70 on the first rib 40, and absorbs the wiped ink.

Figure 7D:
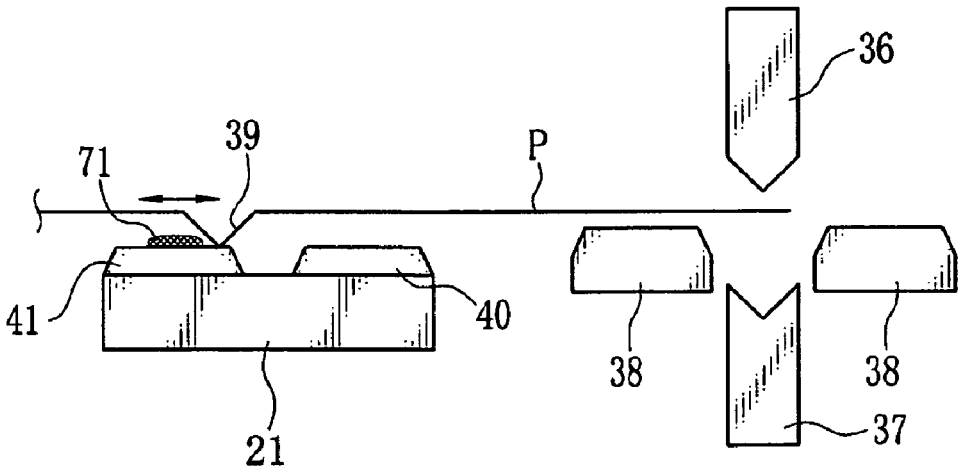

Thereafter, the CPU 50 operates the motor driver 56 to feed the recording medium P to place the downward projection 39 on the second rib 41, as shown in FIG. 7D (step S7). The CPU 50 feeds this recording medium P, so that the downward projection 39 moves back and forth on the second rib 41 (step S8). During this movement, the pointed end of the downward projection 39 slides on the second rib 41, wiping off the ink stain 70 on the second rib 41, and absorbs the wiped ink. The CPU 50 operates the motor driver 56 to discharge the recording medium P onto the paper discharge tray, and finishes the cleaning operation.

Since the first ribs 40 are arranged displaced to the second ribs 41 in the main scanning direction, as shown in FIG. 3, the downward projection 39 touches the first and second ribs 40, 41 in different positions during the cleaning operation. The second ribs 41 are therefore wiped with clean portions which have not wiped the first ribs 40. This leads to reduce ink left-over spots.

Although the user I/F 53 is used to enter a setup value for a projection degree of the downward projection 39 into the CPU 50, the host computer 51 may be used to enter the setup value into the CPU 50 by way of the communication I/F 52. In addition, the ink jet printer 10 may be configured to allow a user to enter the kind of a recording medium P, and adjust a projection degree of the downward projection 39 depending on the kind (variations in thickness, rigidity, etc) of a recording medium P.

It is preferred to change the number of back and forth movements of the downward projection 39 on the first and second ribs 40, 41, depending on a projection degree and/or the kind of a recording medium P. When the downward projection 39 has a small projection degree or when a recording medium P provides lower ink absorbing performance, the number of back and forth movements is increased to surely wipe off ink stain.

Further, it is possible to fix the setup value for the projection degree, disabling changes to the setup value. In this case, the projection degree of the downward projection 39 is preferably in a range of 0.1 mm to 10 mm, and more preferably 1 mm to 4 mm.

Figure 8:
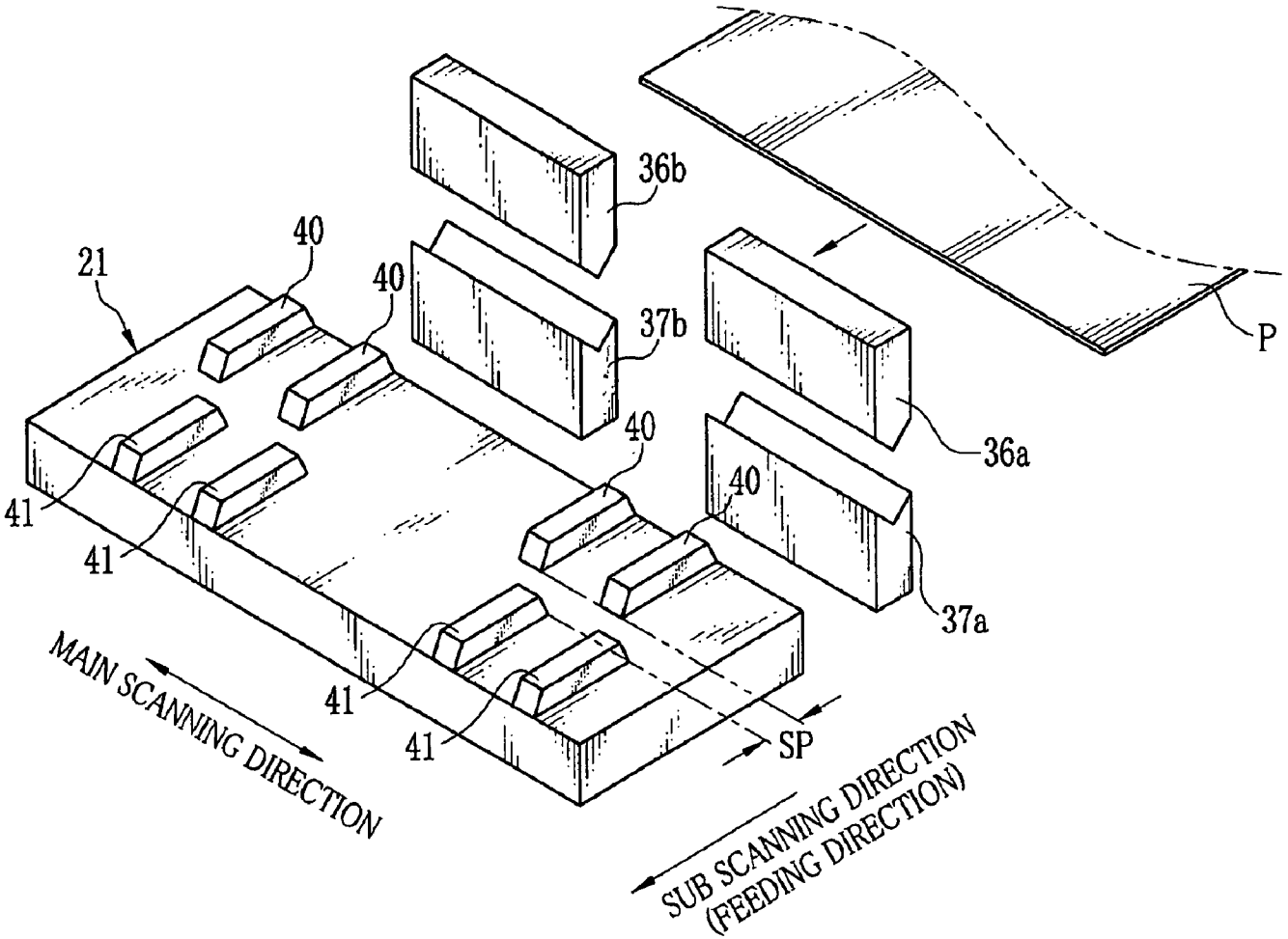
FIG. 8 is a schematic perspective view of a media deforming section according to another embodiment of the present invention.

In the above embodiment, the wedge 36 and the wedge receiver 37 extend continuously in the main scanning direction because, as shown in FIG. 3, the first and second ribs 40, 41 are arranged throughout the main scanning direction. The first and second ribs 40, 41 may, however, be spread in several spots in the main scanning direction. In this case, the wedge 36 and the wedge receiver 37 may be split up, as shown in FIG. 8, into wedges 36*a*, 36*b* and wedge receivers 37*a*, 37*b* corresponding to the spots of the first and second ribs 40, 41. With this configuration, a recording medium P has narrow downward projections only at the positions to face the ribs. A load to feed the recording medium P is thereby reduced to prevent jamming and other feeding errors.

While the ribs on the platen 21 are arranged in two rows, the first ribs 40 in the first row and the second ribs 41 in the second row, the ribs may be arranged in three rows. In this case, the ribs in one row should be displaced from at least the ribs in the adjacent row with respect to the main scanning direction.

Figure 9:
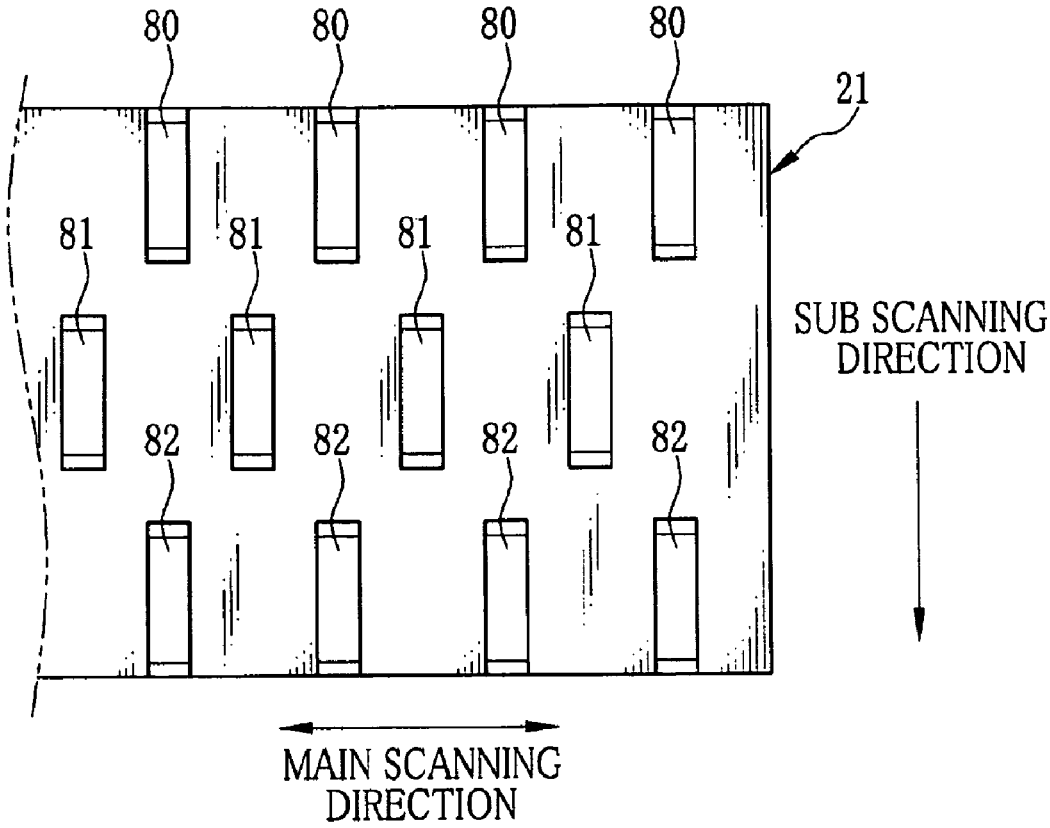
FIG. 9 is a plan view of ribs arranged in three rows.

FIG. 9 shows a three row configuration of ribs. The platen 21 has first ribs 80 in a first row upstream in the feeding direction, second ribs 81 in a second row downstream from the first row, and third ribs 82 downstream from the second row. The first ribs 80 in the first row are displaced, with respect to the main scanning direction, from the second ribs 81 in the second row that is adjacent to the first row in the sub scanning direction. Similarly, the second ribs 81 in the second row are displaced, with respect to the main scanning direction, from the third ribs 82 in the third row. The first ribs 80 and the third ribs 82 end up being aligned in the main scanning direction. Therefore, in the cleaning operation, the downward projection 39 wipes the third ribs 82 with the same portion as used for the first ribs 80. The ink from the first ribs 80, however, has been diffused by a capillary force of the recording medium P when the downward projection 39 reaches from the first row to the third row. The downward projection 39 is now able to absorb the ink on the third ribs 82, and wipes off the ink effectively.

While a pair of the wedge 36 and the wedge receiver 37 is provided in the projection forming station of the above embodiments, additional pairs of the wedge 36 and the wedge receiver 37 may be provided to form two or more downward projections on the recording medium P. These plural projections enable a single recording medium P to wipe each rib many times, and reduce the number of back and force movement to remove ink stains.

Figure 10:
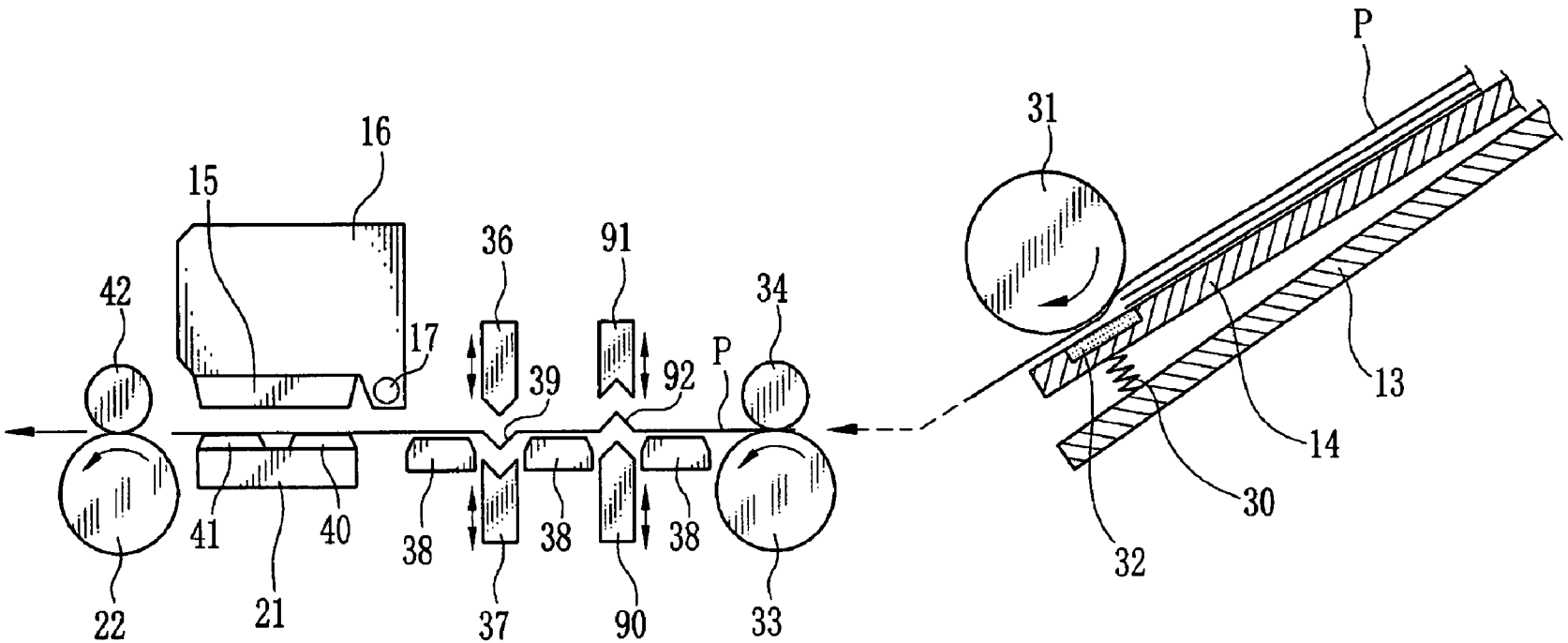
FIG. 10 is a schematic side elevation view of an ink jet printer to form an upward projection as well as the downward projection.

In addition to a downward projection, an upward projection may be formed on the recording medium P to wipe a nozzle face of the recording head 15. For example, as shown in FIG. 10, a wedge 90 and a wedge receiver 91 are provided on an upstream side in the feeding direction from the wedge 36 and the wedge receiver 37. The wedge 90 is placed below the feeding path, and has a V-shaped upper face that projects toward the feeding path. The tip of this lower face extends in the main scanning direction. The wedge receiver 91 has a V-shaped lower face that recesses to fit with the upper face of the wedge 90. The wedge 90 and the wedge receiver 91 are fit together across a recording medium P to deform a part of it into an upward projection 92. By feeding this recording medium P after the formation of the downward projection 39 and the upward projection 92, the nozzle face and the ribs can be cleaned in a single cleaning process.

Figure 11:
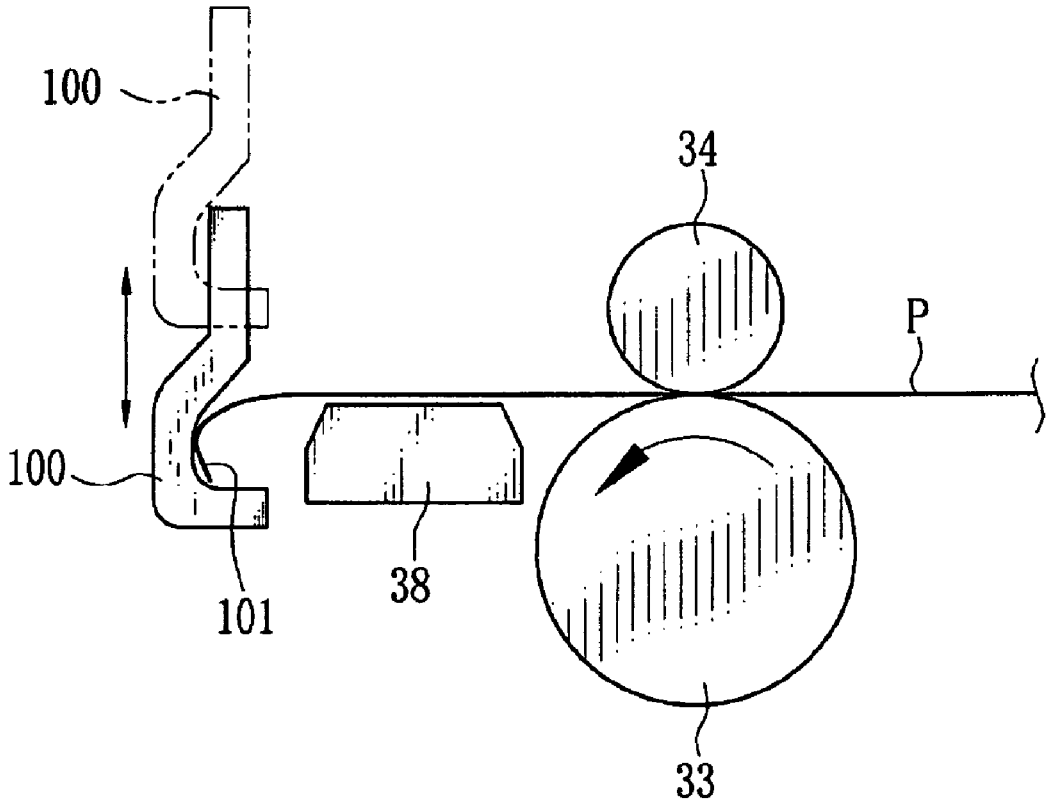
FIG. 11 is a schematic side elevation view of a stopper to form a downward projection.

While the downward projection is formed by joining the wedge 36 and the wedge receiver 37 together, it can be formed with a stopper which blocks the feeding path to bend a leading edge of a recording medium P downwardly. For example, in FIG. 11, there is provided an L-shaped stopper 100 that comes in and out of the feeding path. With the stopper 100 resting on the feeding path, a recording medium P is fed to advance the feeding path, so that the leading edge of the recording medium P bumps into the stopper 100 and bends downward. Thereby, the leading end of the recording medium P deforms into a downward projection 101, and this recording medium P is fed to clean the ribs. This embodiment is simple in configuration, and still able to achieve an effective rib cleaning operation as in the above embodiments.

Although the above embodiments are all directed to an ink jet printer for single-sided printing, the present invention is also applicable to the ink jet printers with duplex printing capability.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An ink jet printer for recording an image on a sheet-like recording medium, comprising:

a feeding mechanism for feeding said recording medium;

a platen for supporting said recording medium during feeding;

a recording head placed above said platen, and for ejecting droplets of ink to said recording medium; and a first media deforming mechanism for deforming a part of said recording medium into a downward projection during a cleaning operation of said platen, said downward projection wiping off said ink on said platen.

2. The ink jet printer of claim 1, wherein said feeding mechanism moves said downward projection back and forth on said platen during said cleaning operation.

3. The ink jet printer of claim 1, wherein said first media deforming mechanism is placed upstream from said platen in a feeding direction of said recording medium.

4. The ink jet printer of claim 1, wherein said downward projection has a V-shape.

5. The ink jet printer of claim 1, wherein said first media deforming mechanism includes a wedge and a wedge receiver below said wedge, and said downward projection is formed by joining said wedge and said wedge receiver together to press said recording medium from above and below.

6. The ink jet printer of claim 5 further comprising guide members disposed on both sides of said wedge and said wedge receiver, and for supporting said recording medium, wherein said first media deforming mechanism changes a position to join said wedge and wedge receiver in an above-below direction, so as to change a degree of projection of said downward projection.

7. The ink jet printer of claim 1 further comprising a second media deforming mechanism for deforming a part of said recording medium into an upward projection used to wipe said recording head.

8. The ink jet printer of claim 2 further comprising first ribs and second ribs arranged in rows on said platen, and aligned in a main scanning direction orthogonal to a feeding direction of said recording medium, said first ribs being displaced from said second ribs in both said feeding direction and said main scanning direction.

9. The ink jet printer of claim 8, wherein said feeding mechanism feeds said recording medium to move said downward projection back and forth on each of said first and second ribs during said cleaning operation.

10. A method of cleaning a platen which supports a sheet-like recording medium below a recording head for ejecting droplets of ink to said recording medium, comprising steps of:

feeding said recording medium to a projection forming station;

forming a part of said recording medium into a downward projection in said projection forming station; and feeding said recording medium to wipe off said ink on said platen with said downward projection.

11. The method of cleaning a platen of claim 10, wherein said ink wiping step comprises moving said downward projection back and forth plural times on said platen.

* * * * *